United States Patent [19]

Burns

[11] Patent Number: 4,605,271

[45] Date of Patent: Aug. 12, 1986

[54] REMOTE QUICK DISCONNECT FOR BREECH-LOK

[75] Inventor: Edgar Burns, Los Angeles, Calif.

[73] Assignee: Automation Industries, Inc., Greenwich, Conn.

[21] Appl. No.: 710,285

[22] Filed: Mar. 11, 1985

[51] Int. Cl.[4] ..... H01R 13/62

[52] U.S. Cl. ..... 339/45 M; 339/91 B

[58] Field of Search ..... 339/91 R, 91 B, 45, 339/46, 69, 70, 72, 73

[56] References Cited

U.S. PATENT DOCUMENTS

| | | | |
|---|---|---|---|
| 3,008,116 | 11/1961 | Blanchenot | 339/91 B |
| 3,165,340 | 1/1965 | Kuehl et al. | 339/91 B |
| 3,422,390 | 1/1969 | Tucker | 339/91 B |
| 3,458,850 | 7/1969 | Calisher | 339/91 B |
| 3,509,515 | 4/1970 | Acord | 339/91 B |

FOREIGN PATENT DOCUMENTS

| | | | |
|---|---|---|---|
| 997445 | 7/1965 | United Kingdom | 339/91 B |

*Primary Examiner*—Gil Weidenfeld

*Assistant Examiner*—David L. Pirlot

*Attorney, Agent, or Firm*—George J. Netter

[57] ABSTRACT

A coupling ring is slideably received onto a cylindrical plug shell that is mateable with a receptacle. A removable end piece in the coupling ring end has an internal set of key ways which correspond to a complementary set of keys on the receptacle. The end piece has shallow recesses on its outer surface which align with passageways extending through the coupling ring. Each passageway has a metal ball of such diameter as to have parts thereof extending inwardly of the opening and into the end piece recesses. A locking ring is slidingly received over the outer end of the coupling ring and includes a first portion which contactingly engages each of the metal balls holding them in an inwardly extending relation into the recesses on the outer surface of the releasable portion (locked mode). The locking ring is movable to a second position in which an inner groove is aligned with each of the passageways extending through the coupling ring so as to release pressure on the metal balls (released mode).

6 Claims, 9 Drawing Figures

REMOTE QUICK DISCONNECT FOR BREECH-LOK

The present invention relates generally to a plug and receptacle electrical connector, and, more particularly, to such a connector which is rapidly and easily released from its mated condition.

BACKGROUND AND FIELD OF THE INVENTION

Plug and receptacle electrical connectors have parts which are releasably fit together so as to connect one or more electrical cable wires together. A highly successful plug and recepticle connector includes a coupling ring which is mounted onto the plug electrical part and rotatable to move the plug and receptacle together or apart, depending upon the direction of rotation.

There are many situations in which it is desirable to be able to quickly unmate a connector in order to protect equipment connected to the cabled or via the connector. For example, one end of the cable may be connected to relatively expensive and sensitive equipment and in the event of high interference signals being impressed upon or induced at the other end of the cable it may be desirable to quickly release an intervening connector in order to prevent damage to the equipment.

There are other situations in which due to relative inaccessibility of the connector mechanical release means are useful. For example, in the event the connector is located at a high overhead location or between two relatively immovable objects, the ability to release the connector parts by manipulation of a cable or lever or the like is desirable.

SUMMARY OF THE DISCLOSURE

A coupling ring is slideably received onto a cylindrical plug shell which plug shell has an open end within for receiving a receptacle during mating of the connector. A removable ringlike portion is located on the open end of the coupling ring and includes an internal set of key ways which correspond to a complementary set of keys on the receptacle outer surface to insure that only mating of a proper plug and receptacle can be achieved.

The releasable ringlike member is slideably received within the open end of the coupling ring and includes a plurality of shallow recesses on its outer surface which align with passageways extending through the coupling ring. Each passageway includes a metal ball of such diameter as to have parts thereof extending inwardly of the opening and into the shallow recesses on the outer surface of the releasable part.

A locking ring is slidingly received over the outer end of the coupling ring and includes a first portion which contactingly engages each of the metal balls and holds them in an inwardly extending relation into the recesses on the outer surface of the releasable portion (locked mode). The locking ring is movable to a second position in which an inner groove is aligned with each of the passageways extending through the coupling ring so as to release pressure on the metal balls (released mode).

The locking ring is spring-loaded so as to maintain it in the locked position which holds the metal balls within the coupling ring with portions thereof lockingly engaging the releasable portion. Pulling on a lanyard translates the locking ring into the released position which allows separating of the plug and coupling ring from the releasable portion which stays with the receptacle.

DESCRIPTION OF A PREFERRED EMBODIMENT

Figure 1:
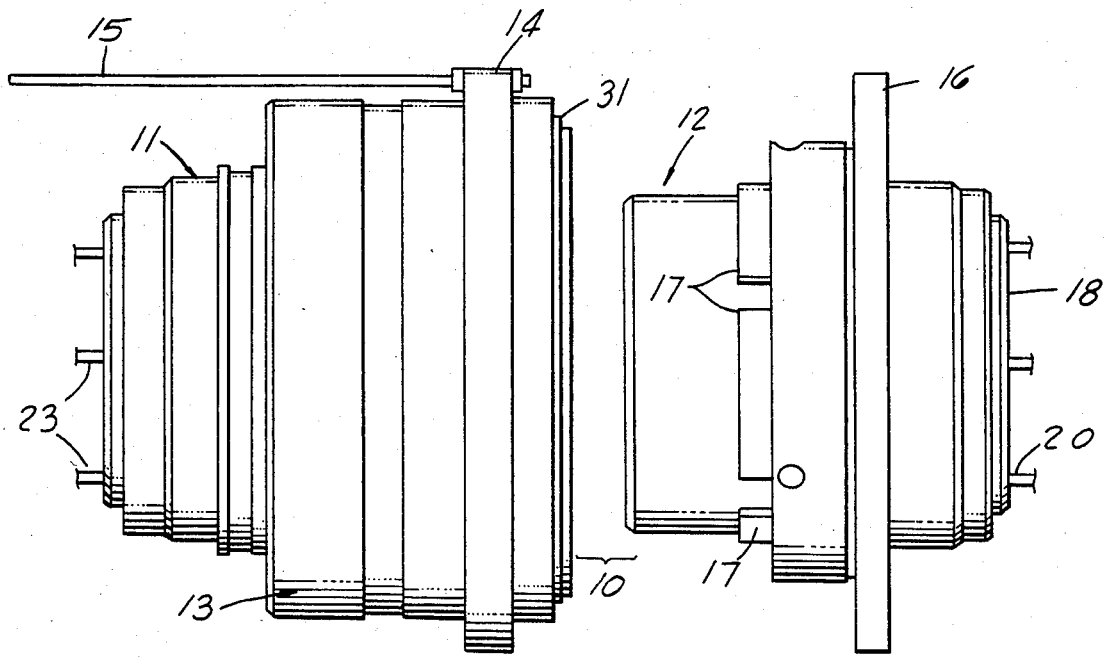
FIG. 1 is a side elevational view of the electrical connector with its parts shown separated.

With reference now to the drawings and particularly FIG. 1, an electrical connector within which is incorporated the rapid releasing means to be described, is innumerated generally at 10. The connector includes a hollow plug shell 11 with internal contacts (e.g. socket contacts) for interconnecting with a receptacle 12 having a complemenary set of internal contacts (e.g. pin contacts). A hollow shell 13 referred to as a coupling ring is slidingly located on the plug shell and rotatable for mating or unmating the plug and receptacle in accordance with the coupling ring direction of rotation. In a way that will be more particularly described, a release ring 14 can be moved axially on the coupling ring 13 by pulling on a lanyard 15 to release the plug and receptacle parts from one another and to pull the plug from the receptacle to a fully unmated condition as shown in FIG. 1.

Figure 2:
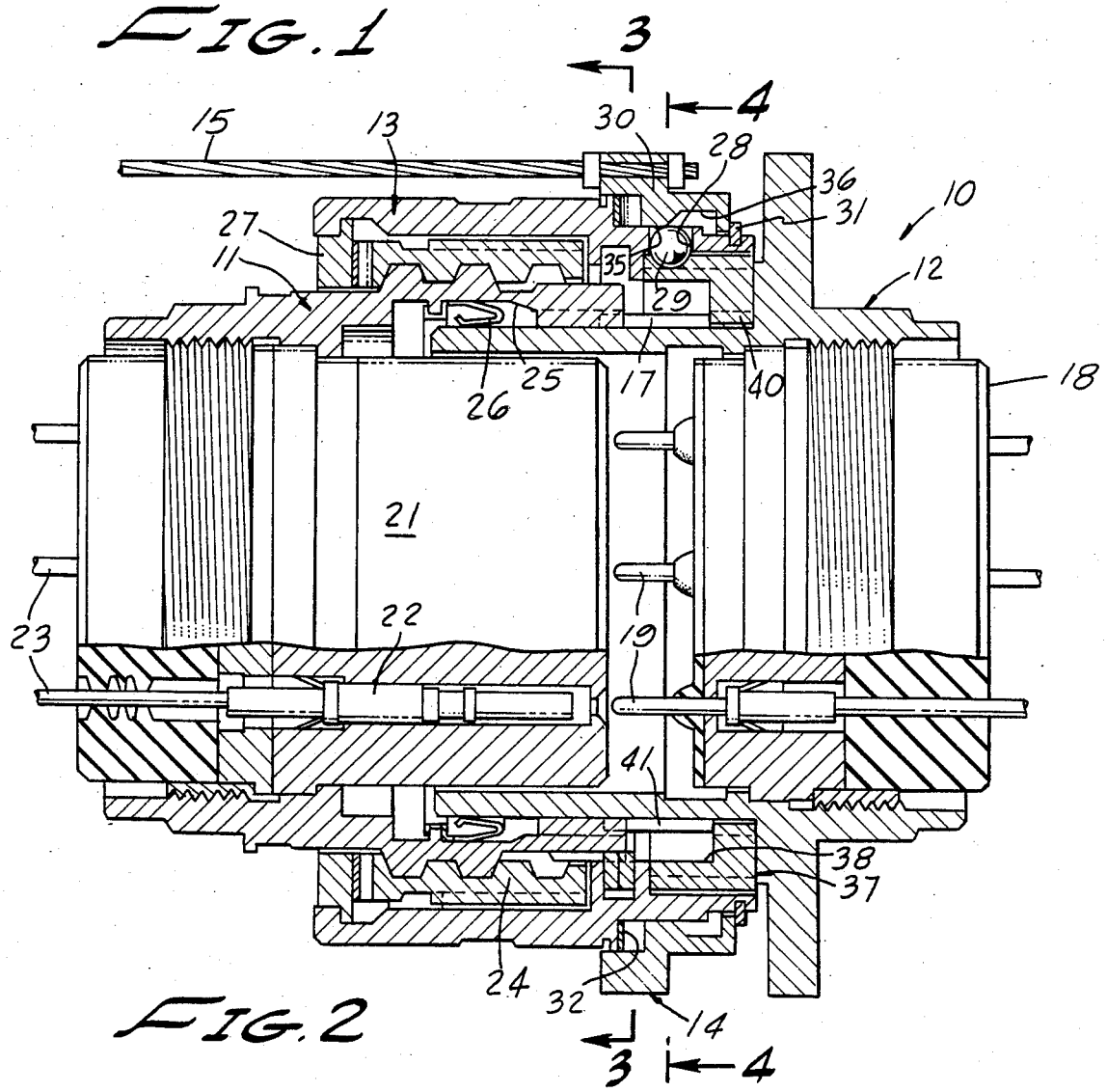
FIG. 2 is a side elevational, sectional view of the electrical connector shown in the intial stages of mating.
Figure 3:
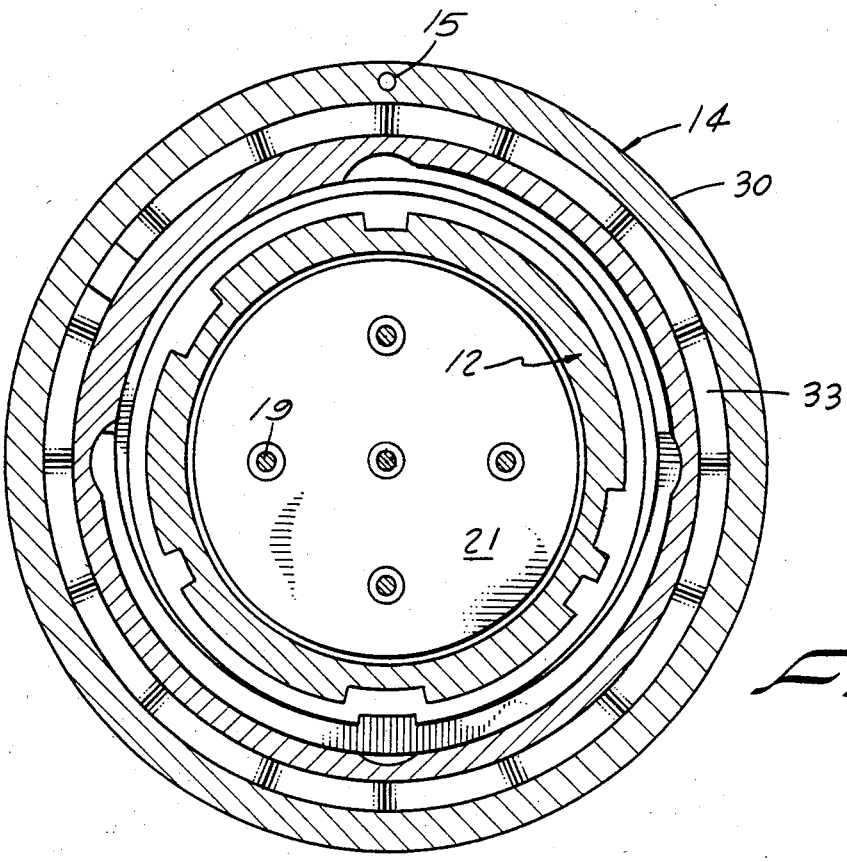
FIG. 3 is an end elevational, sectional view taken along the line 3—3 of FIG. 2.
Figure 4:
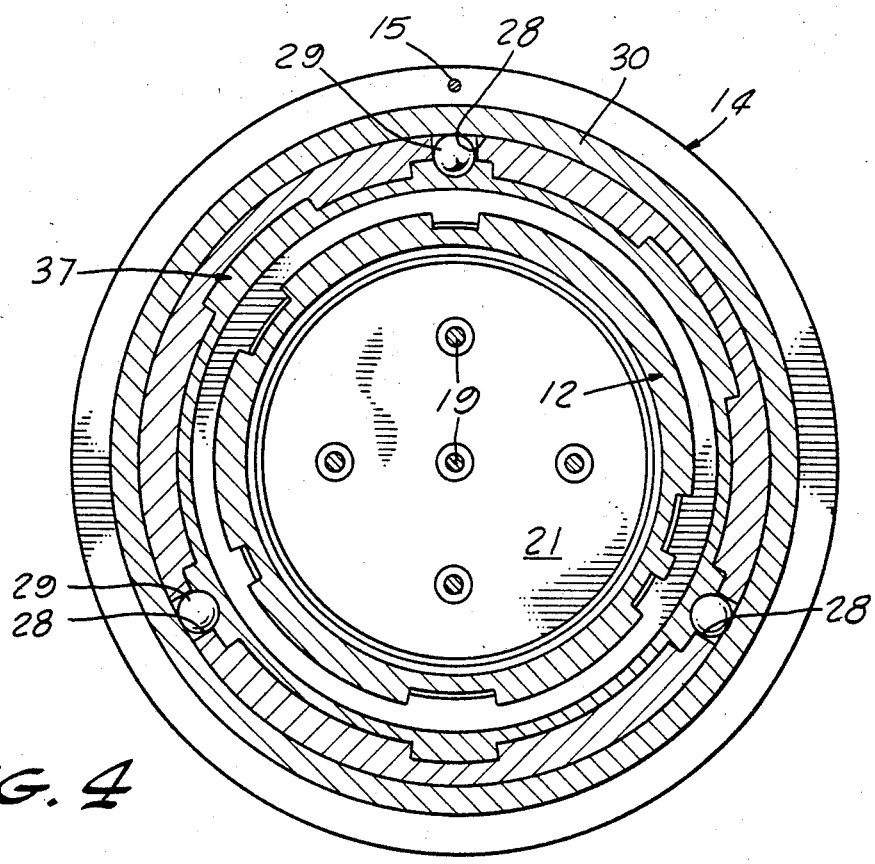
FIG. 4 is an end elevational, sectional view taken along the line 4—4 FIG. 2.

In FIG. 2 the plug and receptacle connector parts are depicted in the initial stages of mating. The receptacle 12 comprises a generally hollow, cylindrical metal shell one end portion of which is received within the plug shell 11 when the connector parts are mated. Conventionally, an enlarged flange 16 extends outwardly about the receptacle for mounting of the receptacle to a support wall, for example. A plurality of keys 17 are formed on the outer surface of the receptacle shell in a coded arrangement corresponding to a similar set of keyways on the interior of the plug shell to be described insures that only a proper receptacle and plug can be mated together.

An insulative insert 18 is received within the receptacle bore and includes a number of passageways extending therethrough parallel to the receptacle axis within which electrical contacts such as pin contacts 19 are positioned. These pin contacts are connected in a way well-known in the art (e.g., crimping) to cable wires 20 which extend from the back side of the receptacle.

The plug shell 11 comprises a hollow cylindrical member with an internal diameter at its open end sufficient to receive the receptacle shell 12 therewithin. An insulative insert 21, similar to the insert 18 for the receptacle, has a plurality of passageways extending axially therethrough within which are positioned socket contacts 22 in an arrangement enabling mating with the pin contacts 19. In a way well-known in the art each socket contact 22 is connected to a cable wire 23 and, in the usual case, additional apparatus such as retainer rings and the like (not shown) may be used to secure the insert within the plug shell and the insert 18 within the receptacle.

The coupling ring includes a generally hollow cylindrical metal shell containing a bore of diameter substantially greater than that of the plug shell 11 and in accordance with a well-known variety of this connector has a shell-like nut 24 retained therewithin, the latter having a set of threads for meshing with a similar set of threads on the outer surface of the plug shell. That is, on rotation of the coupling ring 13 the coupling ring and nut as a unit move along the plug shell, or, viewed slightly differently, rotation of the coupling ring causes the plug shell to move axially with respect to the coupling ring.

The internal surface of the plug shell 11 includes a recess 25 within which there is located a ring shaped leaf spring 26 which serves to close off the space between the plug shell and the receptacle shell during mating of the connector against access of electromagnetic interference that may exist in the immediate environment.

The coupling ring 13 has its rear open end closed off and secured to the plug shell by an annular retainer 27, for example. The opposite open end of the coupling ring through which the receptacle is received includes a plurality of openings 28 extending completely through the coupling ring wall and preferably located at angularly equidistant points about the circular axis and spaced slightly inwardly from the terminus thereof. Each of the openings is tapered slightly from a maximum diameter point on the external surface or periphery of the coupling ring to a smaller diameter point on the internal surface thereby giving each of the openings a tapered character.

A metal ball 29 is received in each of the openings 28 and has a diameter compared to the opening 28 such that with the outer surface of the ball 29 coextensive with the outer peripheral surface of the coupling ring (as shown in FIG. 2, for example) a lower portion of the same ball extends inwardly from the coupling ring into the bore of the coupling ring and for a substantially extent beyond the internal surface of the coupling ring. The taper of the openings 28 is such that although a portion of the metal ball 29 contained therein can extend inwardly from the coupling ring, the entire ball is still retained within the opening 28.

A release ring 30 is a generally cylindrical member which fits over the open end of coupling ring 13 and is prevented from being removed off the open end of the coupling ring by a retaining ring 31. A shoulder 32 formed on the outer surface of the coupling ring 13 has a spring 33 bearing against it and as well against a facing internal shoulder 34 on the release ring 30. Accordingly, the release ring 30 may be moved a short distance axially along the coupling ring 13 by applying force onto lanyard 15 which is affixed to the release ring, on releasing the lanyard pull the release ring is returned to the rest position by spring 33. The inner surface of the release ring has a first surface 35 which is positioned over the outermost set of openings 28 when the release ring is in its relaxed or rest position and held extended by the spring 33 against the retaining ring 31. When the release ring is moved to the left as shown in FIG. 2 (e.g., pulling on the lanyard) this moves an internal circumferential groove 36 on the release ring opposite the openings 28 for a purpose to be described.

A separable end piece 37 consists of an annular body member having a peripheral rim 38 which is so dimensioned as to enable sliding and fitting receipt within the open end of the coupling ring 13. The outer end of the rim 38 has a radially inwardly directed flange 39 which is formed into a plurality of keyways 40 (FIG. 8) of coded arrangement complementary to a set of keys 41 on the receptacle 12 to issue matings of only a proper plug and receptacle.

Figure 8:
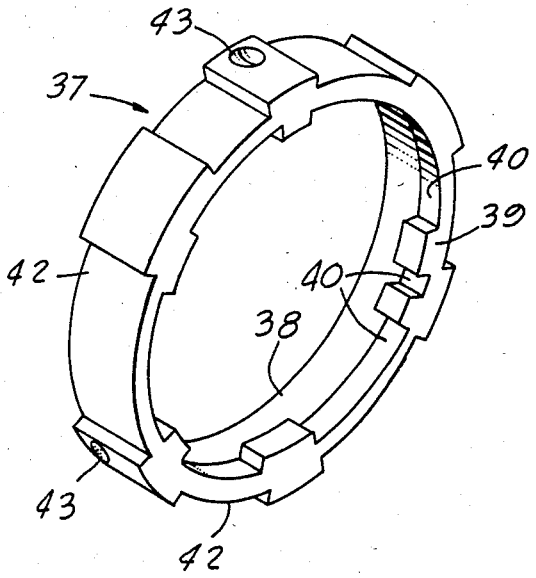
FIG. 8 is a perspective view of the releasable portion of the coupling ring.

Still referring to FIG. 8, the peripheral surface of includes a plurality of axially extending slots 42 of coded width and relative location which correspond to a complementary set of cut-out and intervening raised portions on the internal surface of the coupling ring. By this construction, the separable end piece 37 can only be fit into the end of the coupling when the end piece and coupling ring are in one predetermined angular arrangement.

The surface of certain of the raised portions on the rim 38 each include a shallow recess 43 of dimensions and depth to permit receipt of the portion of the included ball 29 extending inwardly from the coupling ring. Specifically, when the separable end piece 37 is fully received within the coupling ring end (FIGS. 2 and 5), each recess 43 is located immediately opposite an opening 28, and when the release ring 30 is relaxed the balls 29 lockingly engage the separable end piece securely retaining it within the coupling ring.

Figure 5:
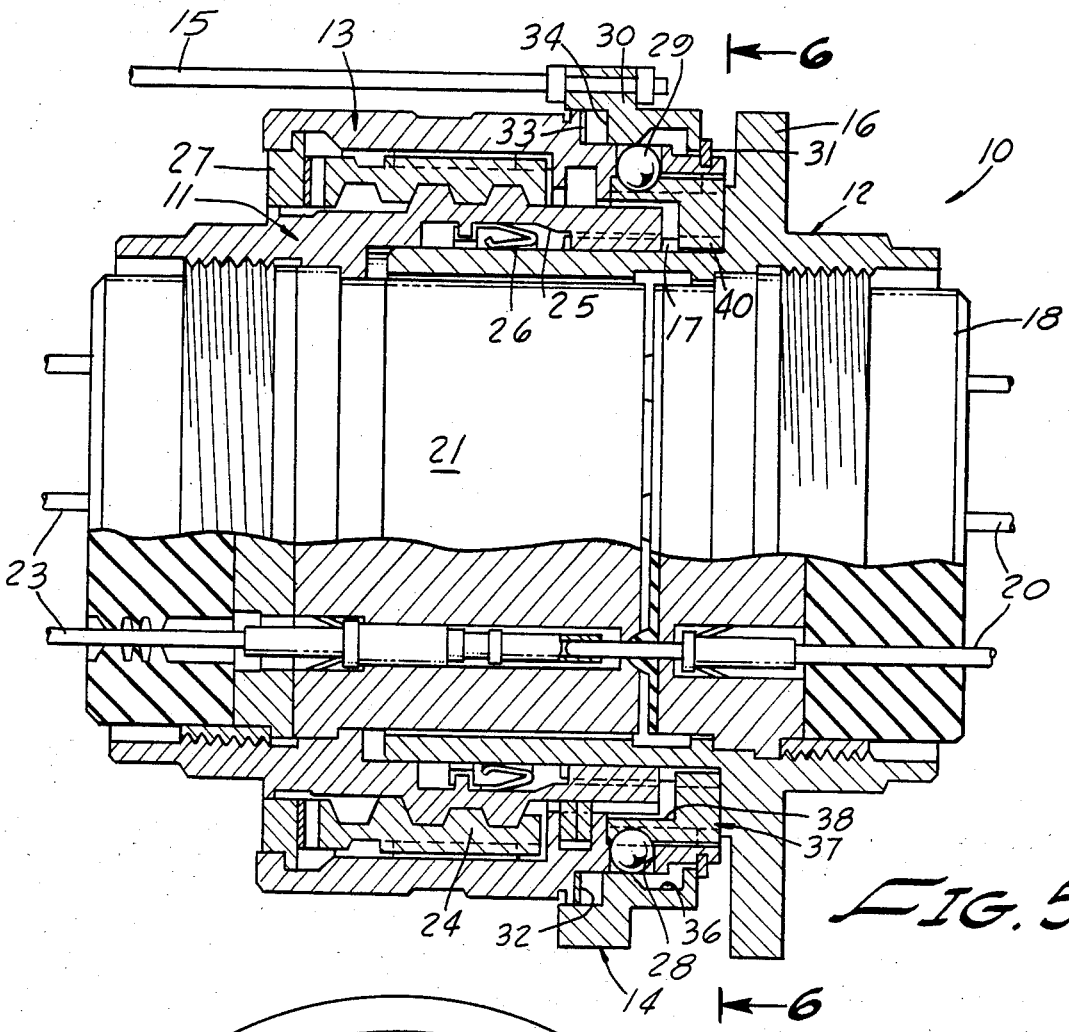
FIG. 5 is a side elevational, sectional view similar to FIG. 2 showing the connector parts fully mated.
Figure 6:
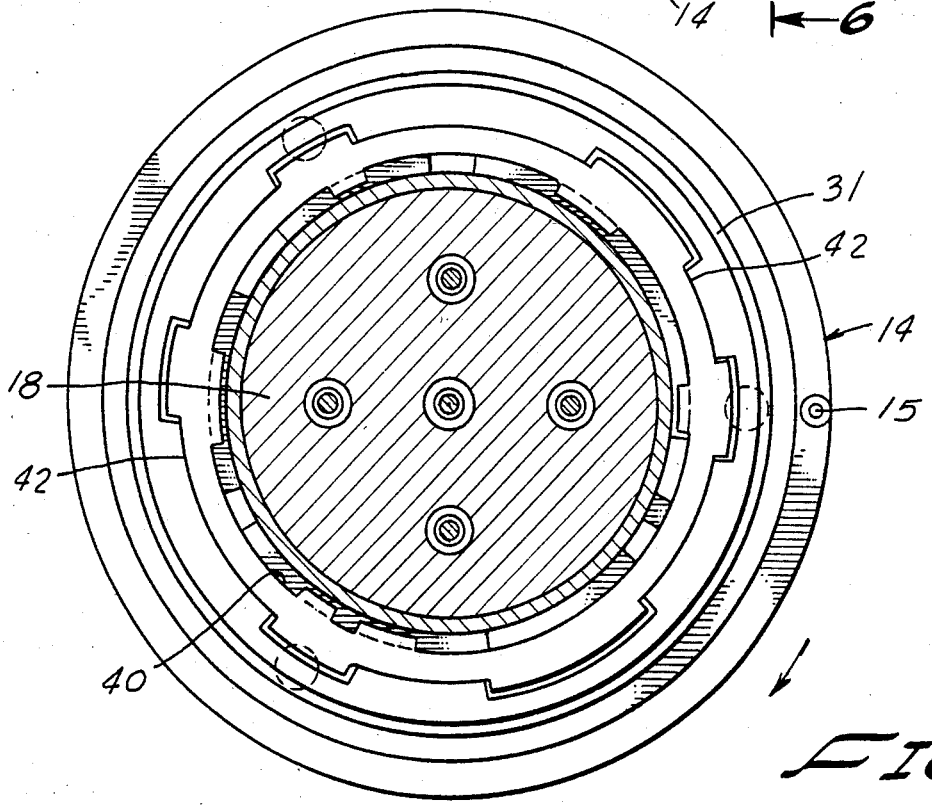
FIG. 6 is an end elevational, sectional view taken along the line 6—6 of FIG. 5.

To mate the connector parts, assume that the separable end piece 37 is received within the coupling ring open end and locked in place, and that no pulling force is being applied to the lanyard 15. First, the receptacle 12 is fitted into the open end of the separable end piece 37, making angular adjustment as necessary to match up the keys and keyways. At this time, the flange 39 is located within a space between the inner end of the keys on the receptacle and the shoulder formed by the receptacle flange 16 (FIG. 2). Rotation of the coupling ring in the correct direct serves to draw the plug and receptacle together to interconnect the pin and socket contacts, and thus the cable wires 20 to 23 (FIG. 5).

Release of the connector may be accomplished in the conventional manner by merely rotating the coupling ring a sufficient amount and pulling the plug and receptacle apart.

Figure 9:
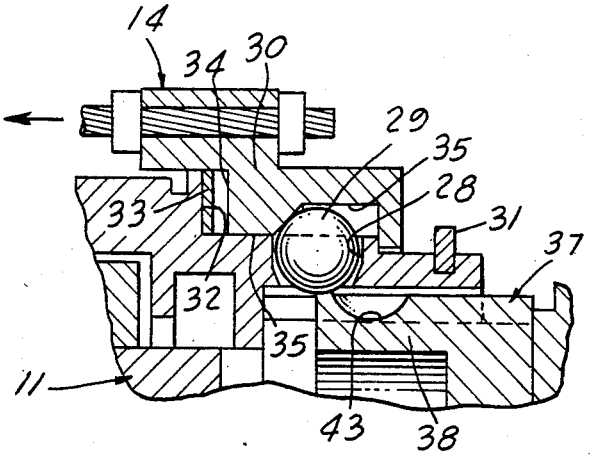
FIG. 9 is a side elevational, slightly enlarged view of the releasable portion shown during disengagement of the parts.

In the event of an emergency requiring rapid release of the connector, a pulling force is applied to lanyard 15 which moves the release so as to locate the groove 36 opposite openings 28 (FIG. 9) releasing each of the metal balls 29 from locking relation with the separable end piece 37. Further pulling of the lanyard disconnects the coupling ring 13 and plug 11 as one unit from the receptacle 12 with separable end piece 37 as a second unit (FIG. 7).

Figure 7:
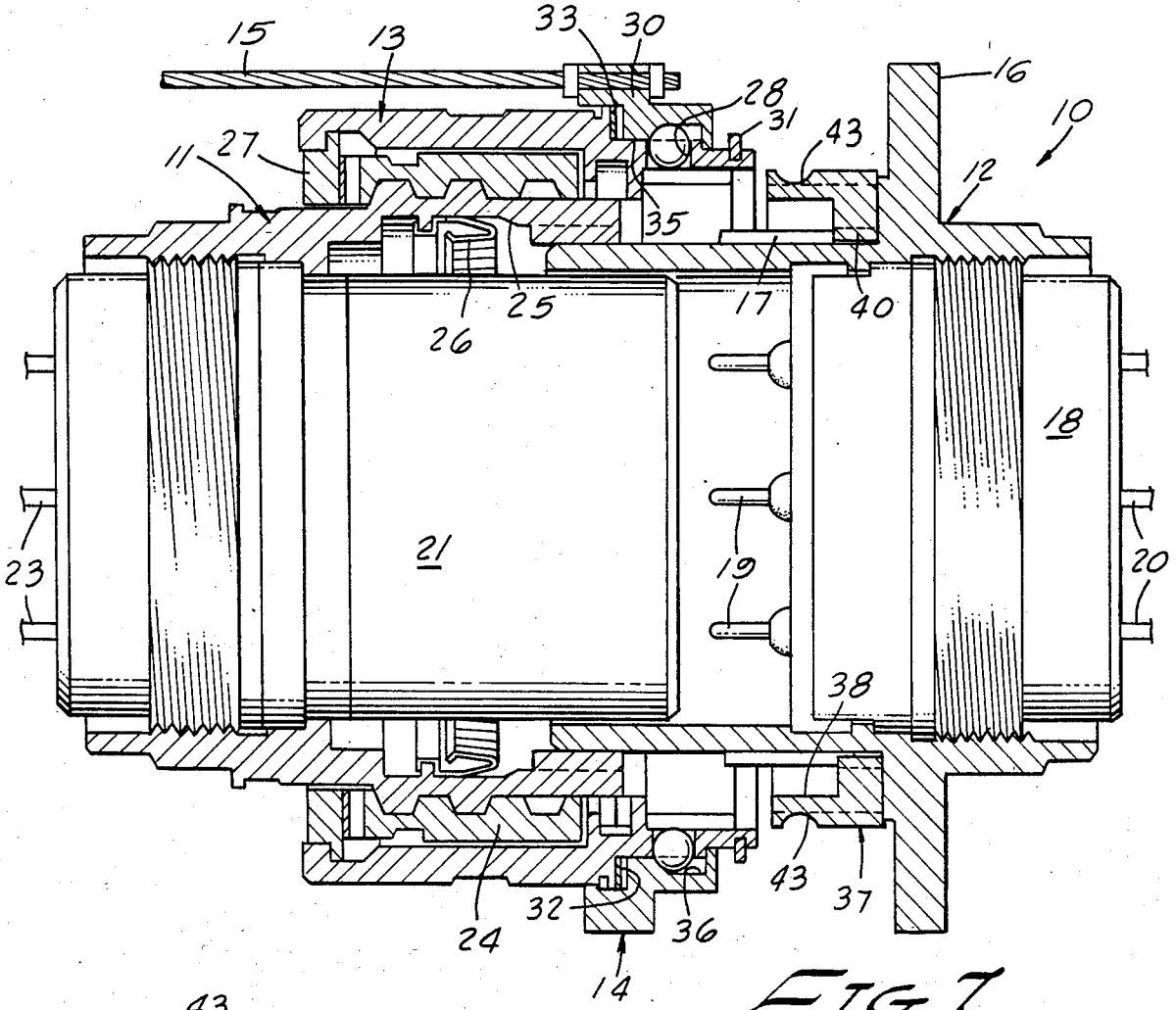
FIG. 7 is a side elevational, sectional view of the electrical connector shown separated or released.

As an additional safety measure, it is to be noted that after a rapid release to the state shown in FIG. 7, release of pulling force on the lanyard now prevents receipt of the separable end piece within the open end of the coupling ring because of the locked extension of the metal balls 29.

What is claimed is:

1. A rapidly releasable connector having a receptacle receivable within a plug shell, and a hollow coupling ring rotatably received on the plug shell for moving the plug shell and receptacle toward and away from each other depending upon the direction of rotation, comprising:

said coupling ring having at least one opening extending radially therethrough at a point spaced inwardly from the outer end;

ringlike means slidingly received onto the outer end portion of the coupling ring and movable from a first position presenting a surface covering the coupling ring opening to a second position locating a recess or the ringlike means directly opposite said openings;

separable end piece means fitted within the open end of the coupling ring and having a recess on an outer surface located directly opposite the opening in the coupling ring, said separable end piece means including a radially inwardly directed flange for engaging the receptacle during mating of the plug shell and receptacle; and a ball located within the coupling ring opening and having parts thereof lockingly extending into the separable end piece means when the ringlike means inner surface is located directly opposite the coupling ring opening, which ball is free to move entirely into the coupling ring opening when the ringlike means recess is directly opposite the coupling ring opening releasing the separable end piece means from the coupling ring.

2. A rapidly releasable connector as in claim 1, in which the coupling ring includes three angularly spaced openings within each of which is received a separate ball, and the separable end piece means outer surface includes three angularly spaced recesses which are individually aligned with respective coupling ring openings.

3. A rapidly releasable connector as in claim 1, in which the coupling ring includes three angularly spaced openings within each of which is received a separate ball, and the separable end piece means outer surface includes three angularly spaced recesses which are individually aligned with respective coupling ring openings.

4. A rapidly releasable connector as in claim 1, in which the coupling ring opening is tapered having a diameter measured at the inner surface of the coupling ring which is less than the opening diameter at the coupling ring outer surface, said ball having a diameter less than the greater coupling ring opening diameter and greater than that of the less coupling opening diamter.

5. A rapidly releasable connector as in claim 1, in which the coupling ring opening is tapered having a diameter measured at the inner surface of the coupling ring which is less than the opening diameter at the coupling ring outer surface, said ball having a diameter less than the greater coupling ring opening diameter and greater than that of the lesser coupling opening diameter.

6. A rapidly releasable connector as in claim 5, in which the coupling ring includes three angularly spaced openings within each of which is receved a separate ball, and the separable end piece means outer surface includes three angularly spaced recesses which are individually aligned with respective coupling ring openings.

* * * * *